US005193333A

United States Patent [19]

Brovelli

[11] Patent Number: 5,193,333

[45] Date of Patent: Mar. 16, 1993

[54] INTEGRATED SYSTEM FOR DRAWING AND SPINNING OPERATIONS

[76] Inventor: Loredana Brovelli, Via Monte Rosa 21, 20149 Milano, Italy

[21] Appl. No.: 694,377

[22] Filed: May 1, 1991

[30] Foreign Application Priority Data

May 18, 1990 [IT] Italy ..... 83387 A/90

[51] Int. Cl.[5] ..... D01H 9/18

[52] U.S. Cl. ..... 57/281; 57/90

[58] Field of Search ..... 57/90, 263, 264, 281

[56] References Cited

U.S. PATENT DOCUMENTS

| | | | |
|---|---|---|---|
| 3,884,026 | 5/1975 | Yoshizawa et al. | 57/281 |
| 4,012,893 | 3/1977 | Weber | 57/281 |
| 4,150,534 | 4/1979 | Raasch | 57/281 |
| 4,735,040 | 4/1988 | Pircher | 57/281 X |
| 4,932,201 | 6/1990 | Meroni et al. | 57/281 X |
| 4,939,895 | 7/1990 | Raasch et al. | 57/281 X |
| 4,956,969 | 9/1990 | Raasch | 57/281 |
| 4,970,856 | 11/1990 | Taniguchi et al. | 57/281 |
| 4,972,669 | 11/1990 | Raasch | 57/281 |
| 4,998,406 | 3/1991 | Raasch | 57/281 |

FOREIGN PATENT DOCUMENTS

| | | |
|---|---|---|
| 3440598 | 5/1986 | Fed. Rep. of Germany . |
| 3505496 | 8/1986 | Fed. Rep. of Germany . |
| 3505494 | 9/1986 | Fed. Rep. of Germany . |
| 3805203 | 8/1989 | Fed. Rep. of Germany . |
| 4018088 | 1/1991 | Fed. Rep. of Germany . |
| 2367843 | 11/1977 | France . |

*Primary Examiner*—Joseph J. Hail, III

*Attorney, Agent, or Firm*—Antonelli, Terry, Stout & Kraus

[57] ABSTRACT

Integrated system for drawing and spinning operations in the processing of textiles, which provides for integration between spinning units (11) and drawing units (13), the integration consisting of a close connection between spinning units (11) belonging to a spinning machine (10) and a drawing unit (13) governed solely by the feed of the spinning units (11), the drawing unit (13) being positioned in line with and at one end of the spinning machine (10), the feed being carried out by means of at least one movable unit (15) able to move along a side or sides (12–112) of the spinning machine (10) and suitable to accommodate and carry sliver containers (14) and to handle the same (14), the containers being full (214) or empty (114) and being used both during drawing and during spinning steps, the integrated system being governed by computerized means that manage and control the devices and functions performing the operational steps.

5 Claims, 2 Drawing Sheets

INTEGRATED SYSTEM FOR DRAWING AND SPINNING OPERATIONS

BACKGROUND OF THE INVENTION

This invention concerns an integrated system for drawing and spinning operations in the processing of textiles. To be more exact, the invention concerns a system that provides for direct connection between the spinning units and the relative drawing units feeding the spinning units.

The system is applied advantageously to the feed of sliver to spinning machines which may be of any known type.

The state of the art covers the problems linked to the carriage and positioning of containers holding the slivers of fibres, particularly so if the slivers are held in cans and the carrying and positioning have to be carried out to the positions of feed on the spinning machines.

A plurality of solutions to overcome these problems has been disclosed, particularly as regards the feeding of opened spinning machines. In this latter case, to which we shall refer in the description hereinafter but which might also concern other types of spinning machines or other machines processing slivers not contained in cans, the known solutions generally include trolleys which are governed by one or more spinning machines and which run along preset tracks in carrying full and/or empty cans to and from suitable temporary storage points for the cans. The trolleys work on one side of a machine at a time in travelling on their preset path.

Examples of such solutions are disclosed in WO-A-06358, FR-A-2,367,843, DE-A-3,440,598 and DE-A-3,505,494.

Solutions are also known in which the trolleys working on the spinning machines are suitable to handle and fill with sliver the empty cans at the place where the cans are used.

For this purpose the trolleys themselves carry a temporary stock of sliver and are equipped with devices able to deposit the sliver in cans which have been emptied during the spinning.

Examples of these solutions are disclosed in EP-A-87202222.3 and EP-A-89105789.9.

All the proposed solutions are very expensive and are particularly inflexible as regards their application. Moreover, they entail preset paths and dimensions which may block the normal movement between the relative rooms and between the machines within the spinning room.

SUMMARY OF THE INVENTION

The present applicant has the purpose of overcoming all the problems of the state of the art by designing, testing and embodying an integrated drawing-spinning system.

The system of the invention provides for integration between spinning units and drawing units in such a way that with an open-end spinning machine consisting of a given number of spinning units there is associated a drawing frame linked to that spinning machine and able to feed sliver continuously to the spinning units.

For this purpose the drawing frame, which, as we said, forms an integral part of a combined drawing-spinning assembly, is positioned in line with, and at one end of, the spinning machine. The drawing frame carries out the filling of spinning cans, which are the cans that are positioned to feed the spinning units.

The cans may be circular and have various diameters to suit the type of spinning machine to be fed or may have other shapes, rectangular or generally elongate, for instance.

The cans are mounted on a suitable trolley or suitable trolleys employed in carrying full and empty cans between the drawing units and spinning units.

The trolley or trolleys not only carry the cans but are also suitable to replace empty cans with full cans and vice versa on the spinning units and on the drawing units.

The drawing frame belonging to the integrated system according to the invention is provided with means and with a loading zone able to place in a waiting position the full cans which will be loaded thereafter onto a trolley.

The area in the vicinity of the drawing frame includes also a zone for discharge of empty cans brought by the trolley; these empty cans wait to be loaded onto a drawing unit.

The zone for loading of full cans and the zone for discharge of empty cans may hold one or more cans as required; these cans are arranged advantageously in preestablished positions depending on the type of structure and form of the trolley employed in handling the cans.

The means which load and position the cans on the trolley may also be located on the trolley itself or be partly located on the trolley and partly on the drawing frame.

At a drawing frame forming part of a given drawing-spinning assembly there may also be provided zones and means to transfer full cans produced by the drawing frame to neighboring drawing-spinning assemblies or spinning machines.

This may happen where, for instance, the type of yarn being processed is changed and the output of a drawing frame exceeds the requirements of its respective spinning machine, and such excess output has to be sent for processing on neighboring drawing-spinning assemblies.

This may also happen where a plant is set up which has been designed from the start for a drawing-spinning assembly to cooperate with one or more neighboring spinning machines.

In the cases described above the trolley or trolleys and their relative paths will be suited to the requirements of the particular situation.

The trolley moving along the spinning units is controlled by a suitable computerized system which, in order to regulate and control the output of the drawing frame, can memorize the sequence of changes of empty cans on the spinning units and the quantity of sliver deposited in the cans. This enables losses of output to be obviated which would otherwise be caused by the simultaneous stoppage of a plurality of spinning units owing to the exhaustion of their feed.

In this case, for instance, the drawing frame may be directed to deposit in the cans a limited quantity of sliver rather than a complete filling of the cans, so as to make more speedy the changing of empty cans at the various halted spinning units.

In general the computerized system performs all the functions required for the proper running of an integrated drawing-spinning system such as that proposed by this invention.

The system of the invention overcomes all the problems relating to the movement of the spinning cans, for this movement will take place in a linear, simple and automatic manner within one single complex consisting of an integrated assembly of spinning units and drawing units linked to the spinning units.

DETAILED DESCRIPTION OF THE DRAWINGS

Figures 1A, 1B, 1C:
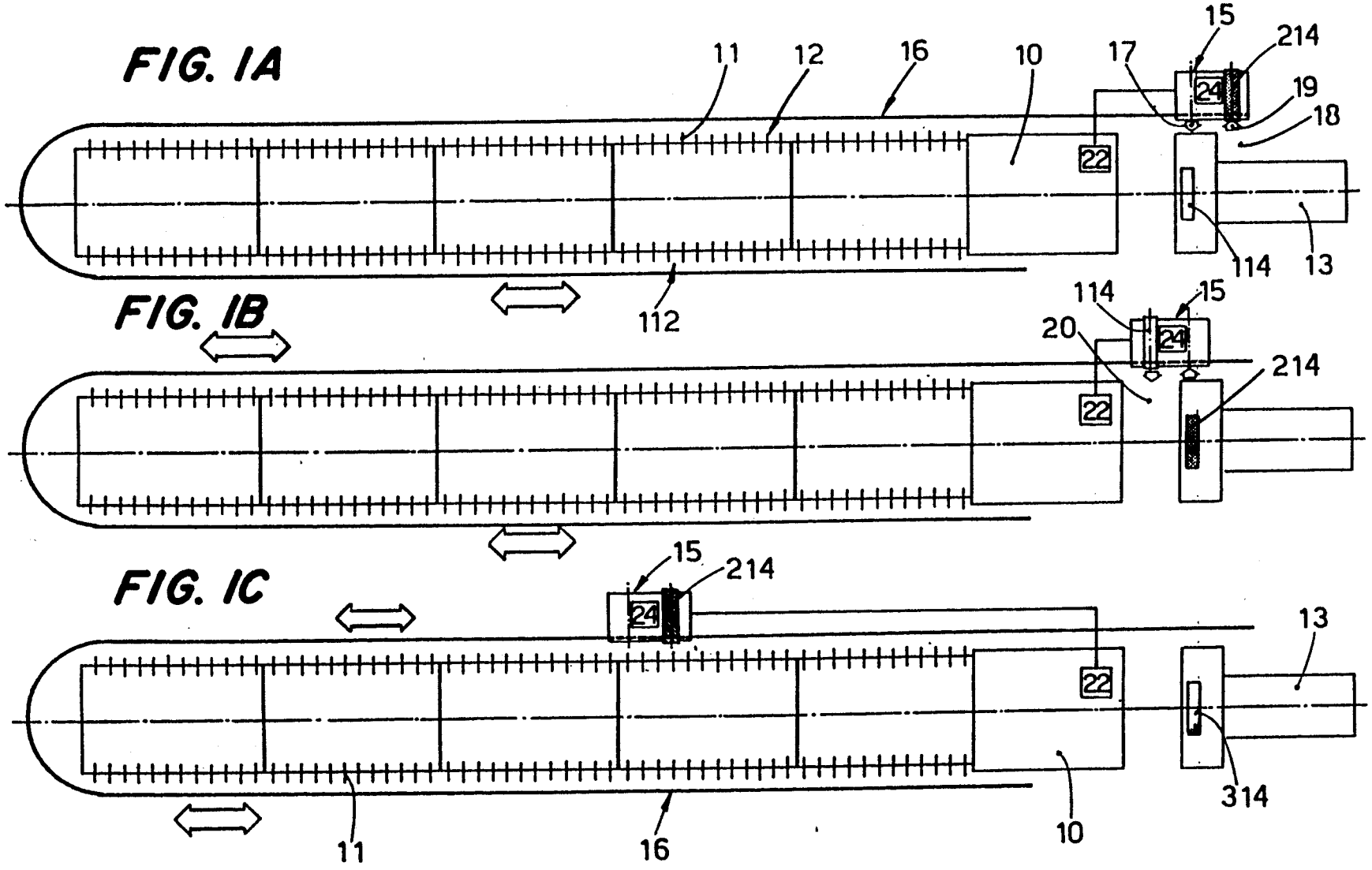
FIGS. 1A-1C, which is given as a non-restrictive examples, shows a diagrammatic plan view of the integrated system according to the invention at work in a spinning room.

FIG. 1 shows as an example three open-end spinning machines 10 comprising a plurality of spinning units 11 arranged along two sides 12 and 112 of the machine 10 as in the state of the art.

A drawing frame 13 is positioned at one end of each spinning machine 10 according to the invention and has a structure and output suitable to feed with sliver the relative spinning units 11 of the spinning machine 10 to which the drawing frame 13 is connected.

Figure 2:
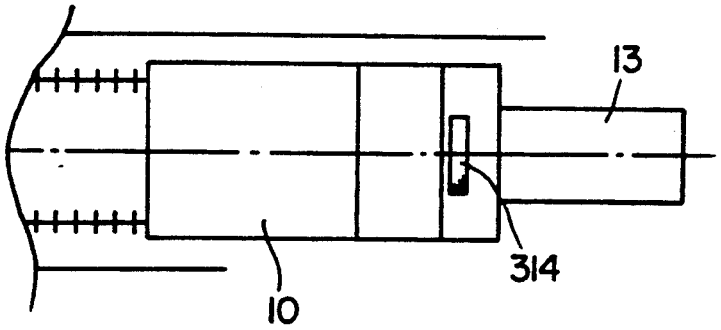
FIG. 2 shows a diagrammatic plan view of a portion of an embodiment of the integrated system wherein the drawing frame and spinning machine are fully integrated.

In the example shown in FIG. 1, each drawing frame 13 is immediately upstream of the respective spinning machine 10 but, as shown in FIG. 2, could equally well be fully integrated with the spinning machine 10 so as to form one continuous, physical structure without any separation.

The spinning machine 10 and its connected drawing frame 13 may share common parts such as actuations, controls, etc.

The drawing frame 13 may also be positioned at the opposite end of the spinning machine 10 to that shown in the figure, while remaining in line with the spinning machine.

As shown in FIG. 1, drawing frame 13 fills with sliver the cans used to feed the respective spinning machine 10; in the example shown these cans are of an elongate or rectangular type 114,214 but can be of any other type.

The cans 114,214 travel along the sides 12-112 of the relative spinning mac 10 on a trolley 15 suitably equipped for the purpose.

The trolley 15 travels on a preset path 16 along the sides 12 and 112 of the spinning machine 10 and to a zone for the loading and unloading of the cans 114,214 at the drawing frame 13.

The trolley 15 is suitably controlled by a computerized system 22, which detects the requirements of the spinning units 11 and directs the trolley 15 accordingly to the units that request supplies of sliver.

The trolley 15 is advantageously equipped also with means 24 to take empty cans 114 from the spinning units 11 and to discharge the empty cans at the drawing frame 13; these means 24 may also be employed to take and discharge full cans 214.

The discharge of empty cans 114 from the trolley 15 and the loading of full cans 214 on the trolley may also be carried out by means connected to the drawing frame 13.

The spinning machine 10 at the top of the figure shows a situation in which the trolley 15 is positioned at the relative drawing frame 13 and has discharged according to the arrow 17 by means belonging to the trolley 15 or to the drawing frame 13 an empty can 114 directly onto the filling position at the drawing frame 13.

The same drawing frame 13 will have positioned beforehand in a neighboring loading zone 18 a full can 214, which in turn is loaded according to the arrow 19 onto its lodgement on the same trolley 15.

After this operation the trolley 15 is ready to travel along its path 16 to the spinning unit 11 which has called for supplies of sliver.

The spinning machine 10 located in the central part of the figure shows, instead, a situation in which a can 214 has just been filled at the drawing frame 13 and is about to be loaded directly on the trolley 15, while an empty can 114 is unloaded from the trolley 15 in a discharge zone 20 bordering on the drawing frame 13.

According to a preferred embodiment of the invention a specially prepared zone is provided at the drawing frame 13 for the discharge of empty cans 114 and the loading of full cans 214. This zone includes at least one preset position respectively for a full can 214, or advantageously several positions for several full cans 214, and for an empty can 114.

The configuration and reciprocal distance between the positions of the full cans 214 and empty cans 114 correspond to the positioning of lodgements for cans on the trolley 15, that is to say, when the trolley 15 reaches and halts at the loading-discharge zone at the drawing frame 13, it is properly positioned to take and load a full can 214 from its respective zone and to discharge an empty can 114 at its respective zone at the same time.

According to another embodiment of the invention, conveyors, simple rollers tables or the like for instance, are connected to the specially prepared loading-discharge zone described above so as to convey full cans 214 to the spinning machines 10 adjacent to the drawing-spinning assembly in question.

Such a lay-out can be employed in cases where a drawing frame 13 connected to its respective spinning machine 10 is able to produce excess quantities, for instance owing to a change in the yarn being processed, and this excess is then transferred for processing on the adjacent machines 10.

The same conveyors can be used also to move empty cans 114, and the paths of the trolleys 15 in question are adjusted consequently.

The spinning machine 10 shown in the lowest part of the figure illustrates the step when the trolley 15 is moving along the side 12 of the machine 10 and is carrying a full can 214, while the drawing frame 13 is filling a can 314 which is advantageously the previously empty can 114 taken by the drawing frame 13 from the discharge zone 20.

We have described here a diagram of a preferred embodiment of the invention, but a person skilled in this field can obviously provide many possible variants. For instance, the trolley 15 can carry a plurality of empty 114 and full 214 cans at the same time, or more than one trolley 15 may be present at the same time; these and other variants are included in the scope of the invention as claimed hereafter.

I claim:

1. An integrated system for drawing and spinning operations in the processing of textiles, which carries out movement of sliver containers, comprising:

a spinning machine including a plurality of spinning units arranged along at least one side of the spinning machine;

a drawing unit positioned in line at an end of the spinning machine and having an output suitable to feed the spinning units of the spinning machine;

a plurality of sliver containers to be filled with sliver from the drawing unit and emptied of sliver by the spinning units of the spinning machine, the sliver containers consisting of cans having an elongate horizontal cross-section;

at least one movable unit movable to an fro along a path adjacent the at least one side of the spinning machine along which the spinning units are arranged, the movable unit suitable to accommodate full and empty sliver containers in preset positions such that a long axes of the cross-sections of the sliver containers are parallel to each other and orthogonal to at least one side of the spinning machine;

a zone positioned adjacent the drawing unit having at least one preset position for full sliver containers and at least one preset position for empty sliver containers, the preset positions of the zone being arranged such the sliver containers are positioned in the zone with the long axes of the cross-sections of the sliver containers parallel to each other and orthogonal to the path of the movable unit;

means for loading and discharging sliver containers from the movable unit;

a computer system for controlling operation of the integrated system.

2. An integrated system according to claim 1, wherein the computer system controls a quantity of sliver to be deposited in the sliver containers at the drawing unit.

3. An integrated system according to claim 1, wherein the drawing unit is integrated with the spinning machine so as to form a single continuous structure.

4. An integrated system according to claim 1, wherein spinning units are provided along two sides of the spinning machine and wherein said movable unit is movable along a path extending adjacent each of the two sides.

5. An integrated system according to claim 1, wherein the preset positions of the zone are spaced to correspond to spacing of the preset positions of the movable unit.

* * * * *